US008296100B2

(12) United States Patent
Schipperijn et al.

(10) Patent No.: US 8,296,100 B2
(45) Date of Patent: Oct. 23, 2012

(54) SYSTEM AND METHOD FOR WELL SURVEILLANCE AND MANAGEMENT

(75) Inventors: Peter Adriaan Schipperijn, Cypress, TX (US); Ana Olga Simonato, Bakersfield, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 580 days.

(21) Appl. No.: 12/262,781

(22) Filed: Oct. 31, 2008

(65) Prior Publication Data

US 2010/0114528 A1 May 6, 2010

(51) Int. Cl.

| | |
|---|---|
| ***G06F 3/01*** | (2006.01) |
| ***G06F 3/023*** | (2006.01) |
| ***G01V 7/02*** | (2006.01) |
| ***G01N 13/00*** | (2006.01) |

(52) U.S. Cl. ..... 702/182; 702/5; 702/6; 702/188

(58) Field of Classification Search ..... 702/6, 9, 702/179, 182, 183, 186; 705/7.32; 717/1, 717/101

See application file for complete search history.

(56) References Cited

U.S. PATENT DOCUMENTS

| | | | | |
|---|---|---|---|---|
| 5,983,164 | A | 11/1999 | Ocondi | |
| 6,904,367 | B2 * | 6/2005 | Cook et al. | 702/13 |
| 7,406,436 | B1 * | 7/2008 | Reisman | 705/7.32 |
| 2002/0038449 | A1 * | 3/2002 | Green et al. | 717/1 |

OTHER PUBLICATIONS

Negnevitsk, Artificial Intelligence, A Guide to Intelligent Systems, Buy Smart: A Frame-Based Expert System, Addison-Wesley, pp. 148-163.

Cedric Bouleau et al., The Big Picture: Integrated Asset Management, Oilfield Review, Dec. 2007, vol. 19, Issue 4, pp. 34-48. See sec. Challenges and Capabilities and From Data to Decision.

Thang N. Nguyen, A decision model for managing software development projects, Information & Management, vol. 43, Issue 1, Jan. 2006, pp. 63-75. See sec. 3. A web-based example implementation of the decision model and 4. Discussions. Implementation challenges.

Shakhawat Chowdhury et al., Fuzzy risk-based decision-making approach for selection of drinking water disinfectants, Journal of Water Supply: Research and Technology-AQUA, 2007, vol. 56, No. 2, pp. 75-93. See sec. FUZZY SET THEORY.

* cited by examiner

*Primary Examiner* — Mohamed Charioui
*Assistant Examiner* — Felix Suarez
(74) *Attorney, Agent, or Firm* — Carlos L. Hanze

(57) ABSTRACT

A method and system is provided for managing well assets. The method includes the steps of determining "first tier" statuses corresponding to pre-defined well attributes, mapping the first tier statuses to one or more well performance classifications, determining "second tier" statuses corresponding to the well classifications, and combining the second tier statuses to determine an overall well surveillance status. The method and corresponding system can be used to manage wells by exception, to readily identify "under-performing" wells, and to prioritize actions to be taken by well operators.

9 Claims, 13 Drawing Sheets

800

Home Surveillance DSC Admin Help

Top Underperforming Wells - Filter

Please choose a Well Filter: Production Information

Set As Default Filter Apply

810 Top Underperforming Wells - Results

Export to:

| | Well Name | Section | Status | Reviewed | Current Rate | Oil(Last - 30d) | Oil(Last - 6m) | % Decline |
|---|---|---|---|---|---|---|---|---|
| 810a | 29 4-98 | 29 | Alert | No | 18.30 | -26.08 | -32.12 | 58.77% |
| 810b | 32G 8-16P | 32G | Alert | No | 23.60 | -18.13 | -34.13 | 43.45% |
| 810c | CAH4 7-7DR | CAH4 | Alert | No | 4.50 | -11.77 | -9.51 | 72.34% |
| 810d | 32G 10-4P | 32G | Alert | No | 42.00 | -11.42 | -11.50 | 21.38% |
| 810e | CAH4 5-8BR | CAH4 | Alert | No | 9.80 | -10.94 | -7.46 | 52.75% |
| 810f | 32G 12-18P | 32G | Alert | No | 16.50 | -10.63 | -15.29 | 38.18% |
| 810g | 32F 10-8A | 32F | Alert | No | 18.00 | -10.18 | -15.45 | 36.12% |
| 810h | 32F 10-7D | 32F | Alert | No | 19.20 | -10.15 | -16.69 | 34.58% |
| 810i | 32G 9-8P | 32G | Alert | No | 30.00 | -9.43 | -9.45 | 23.92% |
| 810j | 29 6-9B | 29 | Alert | No | 64.60 | -9.18 | -1.10 | 12.44% |

820 My Watch List

Export to:

| Well Class | Well Name | Section | Status | Reviewed | Current Rate | Oil(Last - 30d) | Oil(Last - 6m) | Target | Delta |
|---|---|---|---|---|---|---|---|---|---|
| OI | CAH4 3-7 | CAH4 | **OK Producer** | Yes | 11.80 | 0.75 | 4.52 | | |

Change page: ◄< 1 >►

Displaying page 1 of 1, items 1 to 1 of 1.

FIG. 8

900

910 920 930 940 950

Well Groups

DWells
Big Wells
2008 Wells
Special Group

Watch List

CAH4 3- 7
CAH4 4- BW
CAH4 4- 9B

Actions

Back
Add Favorite
Page Help
Reset Page

| Well Class | Class | OK | Marginal | Poor | Last Test | Need Test | Retest | N/A | Yes | No | Down | Down No Job | Count |
|---|---|---|---|---|---|---|---|---|---|---|---|---|---|
| 01 | Performance | 25% | 25% | 25% | | 33.3% | 33.3% | | | | | | 446 |
| | Measurement | 33.3% | | | | | | | | | | | 277 |
| | Pump | 25% | 25% | 25% | | | | 25% | | | | | 163 |
| | Support | 25% | 25% | 25% | | | | 25% | | | | | 1 |
| | Wellbore | 25% | 25% | 25% | | | | 25% | | | | | 853 |
| | WOR | 25% | 25% | 25% | | | | 25% | | | | | 31 |
| | Recent Activity | | | | | | | | 25% | 25% | 25% | 25% | 29 |
| W1 | Performance | 25% | 25% | 25% | 25% | | | | | | | | 626 |
| | Measurement | 33.3% | | | | 33.3% | 33.3% | | | | | | 28 |
| | Support | 25% | 25% | 25% | | | | 25% | | | | | 165 |
| | Injectivity | 25% | 25% | 25% | | | | 25% | | | | | 388 |
| X1 | Performance | 25% | 25% | 25% | 25% | | | | | | | | 4 |
| | Measurement | 33.3% | | | | 33.3% | 33.3% | | | | | | 2 |
| | Stream | 25% | 25% | 25% | | | | 25% | | | | | 16 |
| | Surface | 25% | 25% | 25% | | | | 25% | | | | | 46 |
| | Recent Activity | | | | | | | | 25% | 25% | 25% | 25% | 2 |

FIG. 9

1000

1010 1020 1030 1040 1050 1060 1070 1080

| Surveillance Summary By Class Combination(OI) | | | | | | | | | |
|---|---|---|---|---|---|---|---|---|---|
| Surveillance Status | Performance | Measurement | Pump | Support | Well Bore | WOR | Recent Activity | Occur | Occur % |
| OK | OK | OK | OK | OK | OK | OK | No | 149 | 13.5% |
| OK | OK | OK | OK | Poor | OK | OK | No | 100 | 9.0% |
| Pending Alert | Marginal | OK | OK | OK | OK | OK | No | 88 | 7.9% |
| Pending Alert | Marginal | OK | OK | Poor | OK | OK | No | 52 | 4.7% |
| OK | OK | OK | OK | OK | Marginal | OK | No | 30 | 2.7% |
| Alert | | | | | OK | | No | 29 | 2.6% |
| Alert | Poor | OK | OK | OK | OK | OK | No | 29 | 2.6% |
| Need Test | | Need Test | | | OK | | Down - no job | 27 | 2.4% |
| OK | OK | OK | Poor | | OK | OK | No | 27 | 2.4% |
| Alert | Marginal | OK | Poor | | OK | OK | No | 27 | 2.4% |
| Alert | Alert | OK | OK | Poor | OK | OK | No | 26 | 2.3% |
| OK | OK | OK | OK | | OK | OK | No | 24 | 2.2% |
| OK | OK | OK | OK | Poor | Marginal | OK | No | 24 | 2.2% |
| Alert | Poor | OK | Poor | | OK | OK | No | 21 | 1.9% |
| Pending Alert | Marginal | OK | OK | | OK | OK | No | 18 | 1.6% |
| Pending Alert | Marginal | OK | OK | OK | Marginal | OK | No | 15 | 1.4% |
| Pending Alert | Marginal | OK | OK | Poor | Marginal | OK | No | 14 | 1.3% |

FIG. 10(1)

1000

Surveillance Summary By Class Combination(ST)

| Surveillance Status | Performance | Measurement | Pump | Surface | Recent Activity | Occur | Occur % |
|---|---|---|---|---|---|---|---|
| Need Test | | Need Test | | | No | 149 | 13.5% |
| Alert | | OK | Poor | | No | 100 | 9.0% |
| OK | | | | | No | 88 | 7.9% |
| Need Test | | | | | No | 52 | 4.7% |
| Alert | Marginal | OK | Poor | | No | 30 | 2.7% |
| Alert | Poor | OK | Poor | | No | 29 | 2.6% |
| Pending Alert | Marginal | OK | OK | OK | No | 29 | 2.6% |
| OK | | OK | OK | OK | No | 27 | 2.4% |
| Alert | | | | | No | 27 | 2.4% |

Surveillance Summary By Class Combination(W1)

| Surveillance Status | Performance | Measurement | Pump | Surface | Recent Activity | Occur | Occur % |
|---|---|---|---|---|---|---|---|
| Need Test | | Need Test | | | No | 149 | 13.5% |
| Alert | | OK | Poor | | No | 100 | 9.0% |
| OK | | | | | No | 88 | 7.9% |
| Need Test | | | | | No | 52 | 4.7% |
| Alert | Marginal | OK | Poor | | No | 30 | 2.7% |
| Alert | Poor | OK | Poor | | No | 29 | 2.6% |
| Pending Alert | Marginal | OK | OK | OK | No | 29 | 2.6% |
| OK | | OK | OK | OK | No | 27 | 2.4% |
| Alert | | | | | No | 27 | 2.4% |

FIG. 10(2)

1100

1130 1110

Home Surveillance DSC Admin Help

Well Search

Choose Well

CAH4 - 3-7

CAH4 - 3-7 Pending Alert Since 08/19/08

Apply

Watch List

You do not have any favorite well at the moment

Well Groups

You do not have any well groups at the moment

Actions

Back
Add Favorite
Graph
Page Help
Reset Page

Well Production Neighborhood Details

| Well Name | Manifold | Oil Rate 60d (bbl/day) | Oil Rate 1yr (bbl/day) | Gas Rate 60d (mmcfd) | Gas Rate 1yr (mmcfd) | Water Rate 60d (bbl/day) | Water Rate 1yr (bbl/day) | WOR 60d (bbl/bbl) | WOR 1yr (bbl/bbl) | GOR 60d (mfc/bbl) | GOR 1yr (mfc/bbl) | Azmuth (degree) | Distance (feet) | Surveillance Status |
|---|---|---|---|---|---|---|---|---|---|---|---|---|---|---|
| CAH4 3-7 | SC4 1B | 7.78 | 8.70 | 4.01 | 5.25 | 92.20 | 89.59 | 12.33 | 10.51 | 0.57 | 0.62 | | | Pending Alert |
| Neighbor-hood Avg. | | 16.09 | 15.72 | 7.71 | 8.12 | 122.56 | 112.15 | 9.91 | 9.87 | 0.76 | 1.00 | | | |
| CAH4 3-8A | SC4 1B | 9.45 | 11.69 | 14.56 | 14.10 | 70.76 | 91.01 | 7.33 | 7.78 | 1.39 | 1.20 | 281.44 | 257.31 | Pending Alert |
| CAH4 4-6D | SC4 1B | 26.30 | 23.86 | 4.50 | 5.73 | 115.56 | 109.75 | 4.29 | 4.58 | 0.17 | 0.24 | 30.99 | 353.45 | OK Producer |
| CAH4 4-6 | SC4 1B | 30.43 | 32.22 | 6.01 | 3.88 | 179.19 | 185.95 | 5.33 | 5.76 | 0.21 | 0.28 | 81.52 | 373.08 | OK Producer |
| CAH4 4-7B | SC4 1A | 7.71 | 6.53 | 2.11 | 1.60 | 153.78 | 118.95 | 19.59 | 18.05 | 0.25 | 0.24 | 350.23 | 400.81 | DownTimeCode |
| CAH4 136A | SC4 1B | 6.59 | 4.29 | 11.36 | 10.32 | 88.54 | 55.19 | 12.49 | 13.17 | 1.77 | 3.04 | 298.29 | 519.00 | OK Producer |

Well Injection Neighborhood Details

| Well Name | Manifold | Inj Rate 60d(bbl/day) | Inj Rate 1yr (bbl/day) | Inj Pressure 60d(psi) | Inj Pressure 1yr(psi) | Injectivity 60d(bbl/psi) | Injectivity 1yr (bbl/psi) | Top Perf | Pres Corr Factor | Azimuth (degree) | Distance (feet) |
|---|---|---|---|---|---|---|---|---|---|---|---|
| Neighbor-hood Avg. | | 274.95 | 273.00 | 446.76 | 458.55 | 0.64 | 0.63 | 1854.67 | | | |
| CAH4 4-7W | WTRINJHDR 1 | 390.16 | 377.94 | 453.57 | 404.81 | 0.88 | 0.94 | 1747.00 | | 340.49 | 185.66 |
| CAH4 4-135S | WTRINJHDR 2 | 187.84 | 241.77 | 407.33 | 437.28 | 0.45 | 0.55 | 1950.00 | | 55.06 | 254.33 |
| CAH4 4-135L | WTRINJHDR 2 | 274.50 | 263.62 | 442.29 | 417.41 | 0.62 | 0.63 | 1975.00 | | 55.06 | 254.33 |
| CAH4 4-8B | WTRINJHDR 1 | 275.22 | 248.99 | 414.67 | 354.66 | 0.68 | 0.70 | 1570.00 | | 291.25 | 386.26 |
| CAH4 4-6C | WTRINJHDR 2 | 207.48 | 230.43 | 230.00 | 409.36 | 0.74 | 0.56 | 2070.00 | | 45.08 | 477.30 |
| CAH4 5-6D | WTRINJHDR 1 | 314.53 | 275.24 | 682.71 | 727.76 | 0.47 | 0.33 | 1816.00 | | 17.34 | 515.80 |

FIG. 11

SYSTEM AND METHOD FOR WELL SURVEILLANCE AND MANAGEMENT

FIELD OF THE INVENTION

The present invention relates to a system and method for monitoring, diagnosing and improving the efficiency of oil and gas well operations.

BACKGROUND OF THE INVENTION

Oil and gas well facilities typically include so-called "production" wells and "injection" wells. In oil fields, production wells are used to extract oil and gas, and injection wells are used to facilitate extraction via the introduction of steam, water or other displacement medium into the sub-surface. Both types of wells must be monitored and controlled to ensure optimal and safe operation. Operational tools are often used to control and evaluate the performance of such production and injection wells.

Conventional operational tools, however, are known to utilize expert systems to characterize well operating conditions. These systems monitor the well operating parameters, such as temperatures, pressures and flow rates, each having nominal operating ranges and values corresponding to out-of-limits or alert conditions. Because of interdependencies between multiple parameters, however, these tools often inaccurately diagnose the true operating state of the well thus resulting in increased down time and reduced recovery rates.

Consider for example well operating parameters A, B, C and D, where A is within limits and B, C and D are out of limits. Although the out of limits condition for parameter A may suggest the issuance of an alert or shutdown of the well, experience may indicate that when considered together with nominal conditions for parameters B, C, and D, it may be acceptable or even advantageous to continue operating the asset in a nominal or perhaps degraded mode of operation. Conversely, there may be a need to preemptively shut down or service a nominally operating well based on the aggregate state of various operating parameters.

Thus it is desirable to overcome the above mentioned problem by providing an improved well surveillance system that integrates various operating parameters of the well in a multi-channel manner to more effectively and accurately determine its operating state. Such a system can enable more reliable evaluation and forecasting of well performance, especially in oil fields having a plethora of wells where the availability of operators may be limited.

SUMMARY OF THE INVENTION

A well surveillance method is provided that includes a multi-channel, multi-tier approach for determining the operating status of a well asset. The method includes the determining first tier statuses corresponding to pre-defined well attributes, mapping the first tier statuses to one or more well performance classifications, determining second tier statuses corresponding to the well performance classifications, and combining the second tier statuses to determine an overall well surveillance status. The present invention is especially useful managing wells "by exception" and diagnosing well operations in a consistent, reliable and efficient manner.

Aspects of embodiments of the invention may include a method for managing well operations having the steps of defining a plurality of well attributes representative of well operating parameters, determining attribute statuses for each of the well attributes, and defining a plurality of well performance classifications, and mapping related ones of the well attributes into one or more of the well performance classifications. Well performance classification statuses are derived for each of the well classifications based at least in part on the attribute statuses, and an overall well status derived based on a combination of the well performance classification statuses. The overall well status is then used to identify underperforming wells in the well operations.

Aspects of embodiments of the invention may include a well management system having one or more devices for capturing well attribute data, a computer processor for deriving an overall well status based on the well attribute data and assigned performance classifications, and a display device in communication with the computer processor for displaying the overall well status. In accordance with the present invention, the computer processor determines attribute statuses based on the captured well attribute data, groups a plurality of the well attributes into one or more well performance classifications, derives well performance classification statuses for each of the well performance classifications, and derives the overall well status based on a combination of the well performance classification statuses.

Aspects of the embodiments of the invention may include a computer program for managing well operations. The computer program includes well attribute processing code for defining a plurality of well attributes representative of well operating parameters and for determining attribute statuses for each of the well attributes. The well attribute processing code is communication with well performance classification processing code, which is operable to define a plurality of well performance classifications, group related well attributes into one or more of the well performance classifications, and derive well performance classification statuses for each of the well performance classifications. The well performance classification processing code in turn is in communication with well status processing code, which is operable to derive an overall well status based on a combination of the well attribute performance classification statuses.

Aspects of the embodiments of the invention include a machine readable medium having machine executable instructions for performing any of the above methods and for interacting with any of the above systems.

These and other aspects, objects, features, and characteristics of the present invention, as well as the methods of operation and functions of the related elements of structure and the combination of parts, will become more apparent upon consideration of the following description and the appended claims with reference to the accompanying drawings, all of which form a part of this specification, wherein like reference numerals designate corresponding parts in the drawings identified below. It is to be expressly understood, however, that the drawings are for the purpose of illustration and description only and are not intended as a definition of the limits of the invention.

BRIEF DESCRIPTION OF THE DRAWINGS

A detailed description of the present invention is made with reference to specific embodiments thereof that are illustrated in the appended drawings. The drawings depict only typical embodiments of the invention and therefore are not to be considered to be limiting of its scope.

FIG. 8 is an exemplary display showing under-performing wells in accordance with an embodiment of the present invention;

FIG. 9 is an exemplary display showing well classification statistics by well class and well performance classifications;

FIG. 10 is an exemplary display showing overall well surveillance statuses by well class output combinations; and FIG. 11 is an exemplary display showing overall well surveillance statuses for neighborhood wells.

DETAILED DESCRIPTION OF PREFERRED EMBODIMENTS OF THE INVENTION

Figure 1:
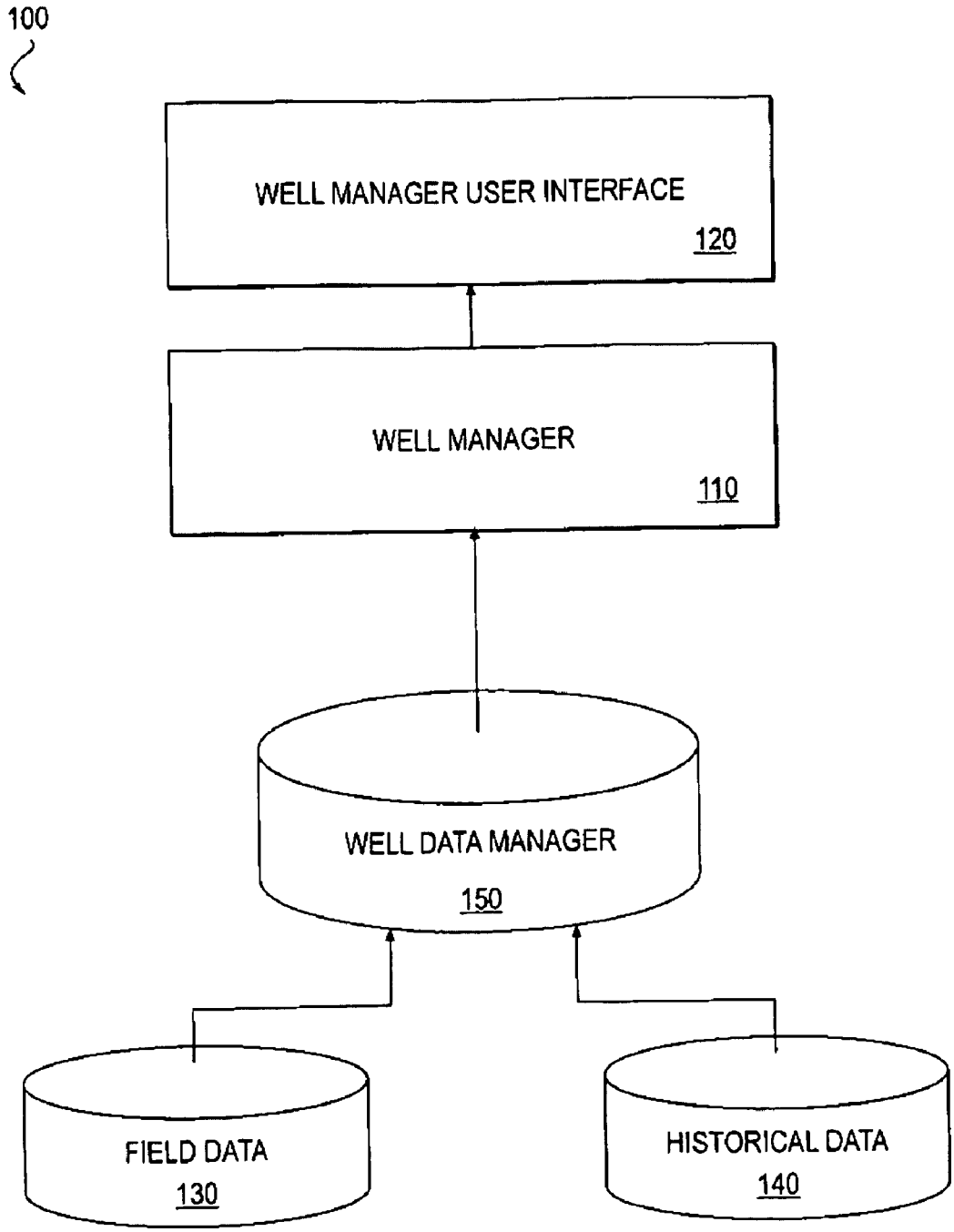
FIG. 1 is a schematic diagram showing an implementation of the well management system of the present invention.

The present invention may be described and implemented in the general context of instructions to be executed by a computer. Such computer-executable instructions may include programs, routines, objects, components, data structures, and computer software technologies that can be used to perform particular tasks and process abstract data types. Software implementations of the present invention may be coded in different languages for application in a variety of computing platforms and environments. It will be appreciated that the scope and underlying principles of the present invention are not limited to any particular compute software technology.

Moreover, those skilled in the art will appreciate that the present invention may be practiced using any one or combination of computer system configurations, including but not limited to single and multi-processer systems, hand-held devices, programmable consumer electronics, mini-computers, mainframe computers, and the like. The invention may also be practiced in distributed computing environments where tasks are performed by servers or other processing devices that are linked through a one or more data communications network. In a distributed computing environment, program modules may be located in both local and remote computer storage media including memory storage devices.

Also, an article of manufacture for use with a computer processor, such as a CD, pre-recorded disk or other equivalent devices, could include a computer program storage medium and program means recorded thereon for directing the computer processor to facilitate the implementation and practice of the present invention. Such devices and articles of manufacture also fall within the spirit and scope of the present invention.

Referring now to the drawings, embodiments of the present invention will be described. The invention can be implemented in numerous ways, including for example as a system (including a computer processing system), a method (including a computer implemented method), an apparatus, a computer readable medium, a computer program product, a graphical user interface, a web portal, or a data structure tangibly fixed in a computer readable memory. Several embodiments of the present invention are discussed below. The appended drawings illustrate only typical embodiments of the present invention and therefore are not to be considered limiting of its scope and breadth.

FIG. 1 shows an embodiment of a well management system 100 for monitoring and diagnosing well performance. Although the well management system 100 is described for the monitoring and diagnosing oil well operations, the system 100 could be adapted for monitoring and diagnosing other types of wells such as gas, geo-thermal, and water wells. The well management system can also be adapted, for example, to automatically monitor and troubleshoot well test equipment, and in the case of gas wells, to determine when artificial lift by a plunger may be required.

The well management system 100 includes a well manager or processing engine 110 for generating well surveillance statuses, a well manager user interface or presentation layer 120 for displaying well statuses and alerts, and well database components or systems of record (SOR) 130 and 140 for providing field and historical data to the well manager 110. The processing engine 110 may be implemented on an SQL Server database, which may also include as pre-processor (not shown). The pre-processor has two primary purposes. It extracts the well measurements, e.g. oil flow rate from a well test, steam quality data, etc., from the SORs and computes the attribute based on those measurements, e.g., trend of oil rate over time, percent of recommended latent heat achieved, etc. The computed attribute numeric values become inputs to the processing engine. The presentation layer 120 may be implemented as a webpage or created using commercially available products such as TIBCO Spotfire® or MS Access®. SORs 130 and 140 may include commercially available products such as Paradigm Geolog®, and can be used to capture field and historical data according to a number of criteria including well type, field and business unit. Optional well data manager 150 is shown for data warehousing field and historical dated in common formats. Sensors (not shown) can provide field measurements and other data directly to the well manager 110.

In accordance with an embodiment of the present invention, the well manager 110 executes a computer implemented well surveillance method that diagnoses well operating conditions using a "multi-channel" or "multi-tiered" approach. Well surveillance is a critical part of well management workflow as it may lead an operator or engineer or other domain expert to take prescriptive action, (e.g. replace a worn part), adjust the well's operation (increase pump speed), conduct a follow-up analysis or test (e.g. determine the fluid level), continue to monitor well performance, or simply conclude that the well is performing within normal operating parameters.

Figure 2:
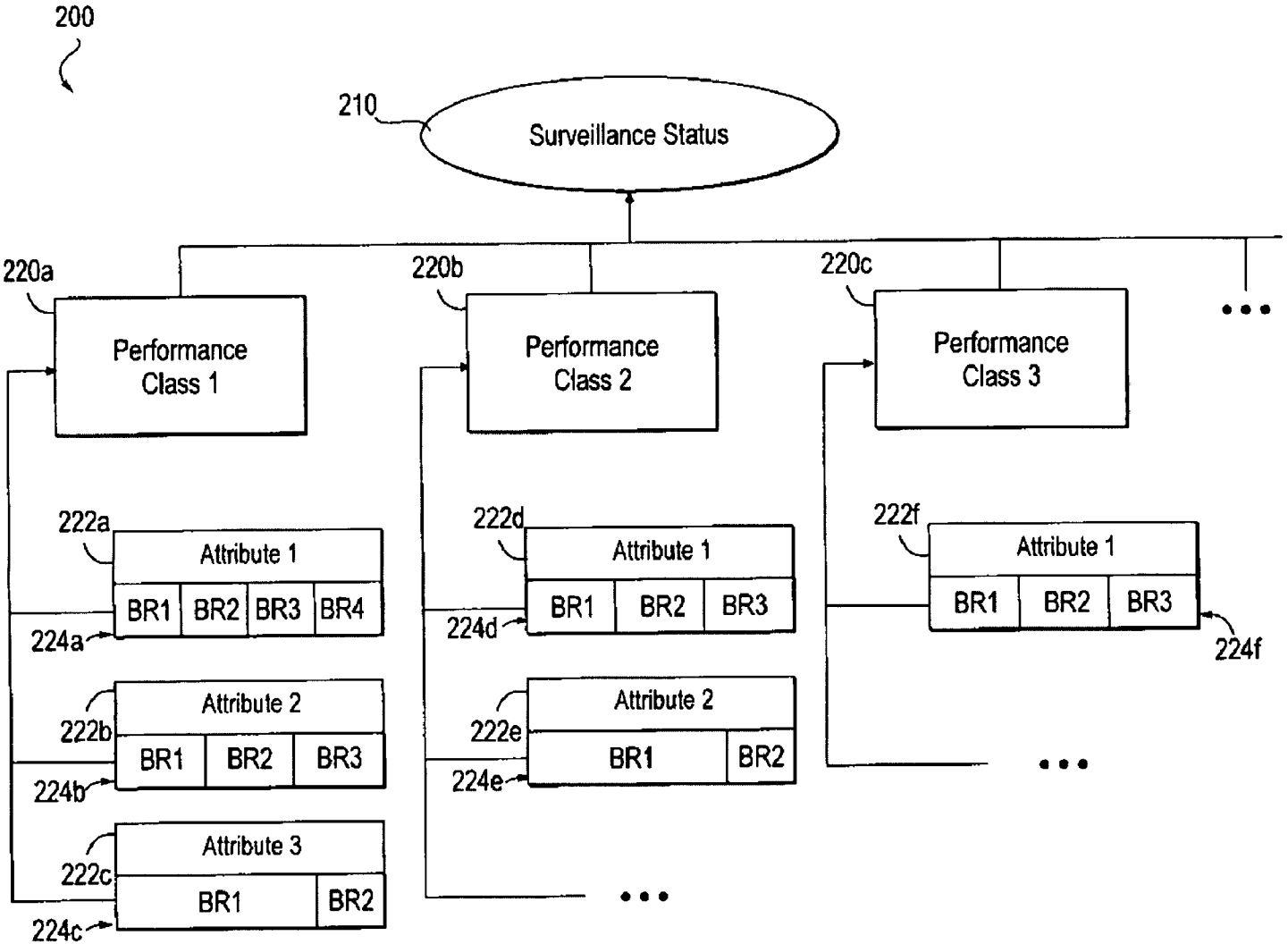
FIG. 2 is an illustration showing an example of the multi-tiered approach for well surveillance in accordance with a method of the present invention.

To adequately convey the method of the present invention, reference is now made to FIG. 2 showing surveillance status 210, performance classes 220*a-c*, attributes 222*a-f*, and business rules 224*a-f* and their inter-relationships. As shown in FIG. 2, the well surveillance comes in three hierarchical levels of detail. The most general level is the Surveillance Status 210 which gives an overall assessment of the well's current performance. In accordance with one embodiment of the present invention, the Surveillance Status 210 conveys two pieces of information: the status from a limited list of possible diagnostic outputs, i.e., outputs that a filterable, and a free-form comment field to provide extra context of the diagnosis.

Next in the hierarchy are performance classes or classifications 220*a-c*, which in accordance with the present invention represent intrinsic aspects of a well. Performance classes are groupings of well attributes according to a pre-determined or observed relationship among them. The groupings could be based on heuristics, statistical or historical analysis of critical well characteristics such as well operating parameters, performance criteria, well subsystems, well components (such as pumps and sensors), resources and materials applied to the well (such as water and heat), well location and proximity, work or operator activities, maintenance activity, safety requirements, etc.

Performance classes may also be defined as particular performance categories. Examples of such categories are injection support for producing wells, and the quality and relevance of recent measurements, e.g., is the most recent well test of suitable vintage to provide a relevant indication of the well's current performance?.

In accordance with the present invention, one or more of the performance classes may be configured in the hierarchy as needed to interrogate all factors that affect well performance in the field. Performance classes for production wells, for example, may include: "Recent Activity" (i.e., the assessment whether recent well work has impacted the near term measurement window that would preclude further analysis); "Production Measurement" (i.e., an integrity check of recent well measurements to determine if they are of sufficient quality for use in diagnosis); "Production Performance" (i.e., with regard to current production, it determines how the rate and trend of the rate compare to the well's recent history and to that of offset neighbor wells); "Pump" (i.e., a class to evaluate the of the integrity of the lift system and characterize its performance); "Production Support" (i.e., an evaluation of the level of steam or waterflood support); "Water-to-oil ratio (WOR)" (i.e., to quantify the amount of water produced and its rate of change); and "Wellbore" (i.e., a class that identifies opportunities to enhance production by changing pump depth or whether the potential for a sidetrack completion exists).

Exemplary performance classes for steam injection wells may include: "Recent Activity" (same as with production wells); "Injection Measurement" (i.e., an assessment of whether enough recent data exist to proceed with diagnosis and whether the steam is entering the intended zones; "Steam Performance" (i.e., an evaluation as to the degree to which the injection volume, steam quality and latent heat targets are being met); and "Steam Outflow" (i.e., an assessment of the percent of steam critical flow rate achieved). Exemplary performance classes for water injection wells may include: "Recent Activity" and "Injection Measurement" (same as with production and steam injection wells, respectively); "Injection Performance" (i.e., an assessment of the injection well's ability to achieving its rate target while satisfying the pressure limit); "Injection Support" (i.e., a class to assess the degree of pattern support through the integration of the injection withdrawal ratio [IWR] and rate information along with data on surface movement); and "Injectivity" (i.e., a class to assess the integrity of the injection system).

Performance class definitions need not be mutually exclusive, e.g., in the case of production wells, the Production Decline class may be influenced by the Pump Performance class. Tradeoffs exist in selecting the number of performance classes. The greater the number, the broader the range of the diagnostic interrogation but at the expense of requiring greater number of decode evaluations to maintain at the class level as will be discussed below. In general, five to seven performance classes are an optimal range for oil well surveillance.

Figure 3:
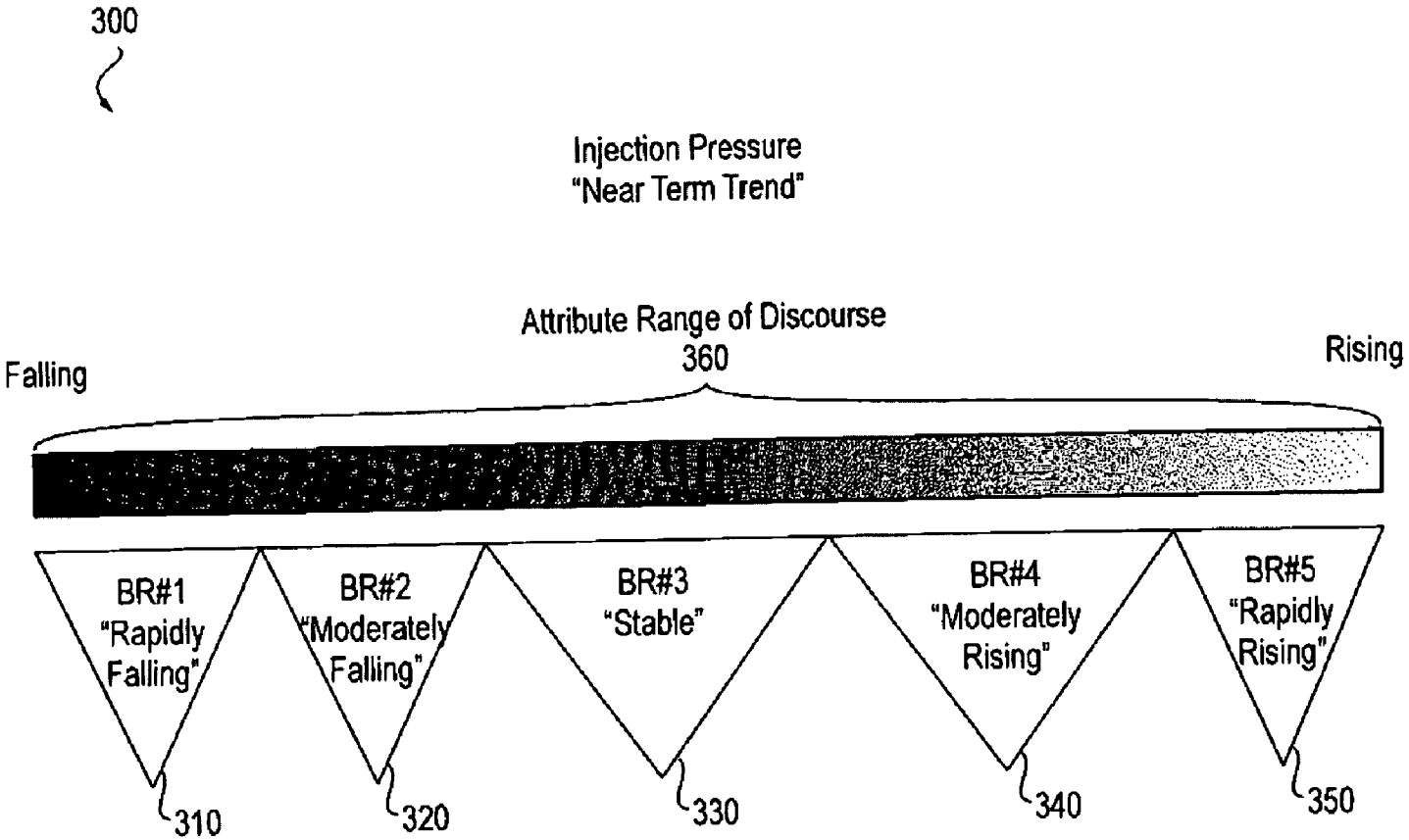
FIG. 3 is a diagram illustrating an exemplary well attribute and corresponding business rules in accordance with the present invention.

FIG. 3 shows the third level of well surveillance. An exemplary well or "Tier 1" attribute 300, "Injection Pressure Near Term Trend," is defined generally as an operating or performance characteristic of a well, in this case near term trend of injection pressure within the well tubing of water injection wells. Examples of attributes may also include oil production rate, oil rate change, pump efficiency, injected water rate (IWR), pressure, etc. An attribute may be an observation, an inference from an observation, measurement, or a calculation involving one or more measurements taken by monitoring devices. A daily flow rate is an example of a measurement where the trend of the flow over time would be a calculation. Some well attributes relate to a rate of change of a measurement over time. This can be accomplished using the technique of least squares to determine the slope and intercept of a line that provides the best fit to the data. As shown in FIG. 3, well attributes are characterized by one or more ranges of minimum and maximum values which may be continuous as in the case of the daily flow rate, or discontinuous as in the case for example of a binary output indicating whether a recompleted well has successfully met all the criteria of the Post-POP (Put-of-Production) Process, which is a checklist of performance benchmarks and the completion of necessary activities once a well is placed into service.

In accordance with the present invention, an attribute is assigned to of one or more performance classes. In the case of Near Term Pressure Trend 300, the attribute belongs to the "Injection Performance" class for injection wells. The Injection Performance classification includes: "Injection Pressure Near Term Trend" (i.e., Trend of the tubing pressure over the near term window); "Injection Pressure to Target" (i.e., Tubing pressure expressed as a percentage of the pressure limit averaged over the near term window); "Injection Rate NT Trend" (e.g., Trend of the injection rate over the near term window); "Injection Rate to Target" (e.g., Injection rate expressed as a percentage of the target rate average over the near term window). One to six attributes per class is an optimal range to provide a meaningful well surveillance capability at a manageable number of class decode evaluations to maintain.

Referring again to FIG. 3, each attribute is partitioned over its range of discourse into two or more non-overlapping zones called business rules. The placement, size, and number of the business rules are flexible and can be assigned in accordance with the perceived judgment of the system's behavior. For example, the pump efficiency attribute may be partitioned into three business rules: "Low Efficiency" from 0 to 30%, "OK" from 30% to 100%, and "Check Pump Configuration" when the efficiency is calculated to be above 100%. The positioning of boundaries drives the relative distribution of the business rule populations which in turn drive the class and surveillance status distributions over the field. The boundaries may be subsequently fine tuned to achieve an acceptable population distribution at the class and surveillance level. Generally, business rules may abut each other or be separated by gaps within the range of discourse. The business rules may be customized based on customer needs or preferences. In the case of attribute 300 in FIG. 3, business rules or states 310-350 are assigned based on the value of the attribute "Injection Pressure Near Term Trend." Business rule "Rapidly Falling" 310 defines one end of the range of discourse, and business rule "Rapidly Rising" 350 defines the other. Business rule boundaries can be determined based on heuristical, statistical or historical analysis of critical well attributes, and can be automatically created or updated using learning algorithms, neural networks and other artificial intelligence techniques.

A tradeoff exists in selecting the number of business rules for an attribute in that the greater the number of business rules, the finer the resolution of diagnosis and thus the greater the number of decodes to maintain. For most attributes two up to four perhaps occasionally five is an adequate number of business rules.

As a further consideration, it is preferred that intrinsically related attributes should not be grouped across multiple classes since this would have the tendency to over-emphasize those attributes. As an example, placing pump efficiency in a "Pump" class and pump run time in a "Production Decline class may overstate the effect of a malfunctioning pump since it typically exhibits both behaviors.

Figure 4:
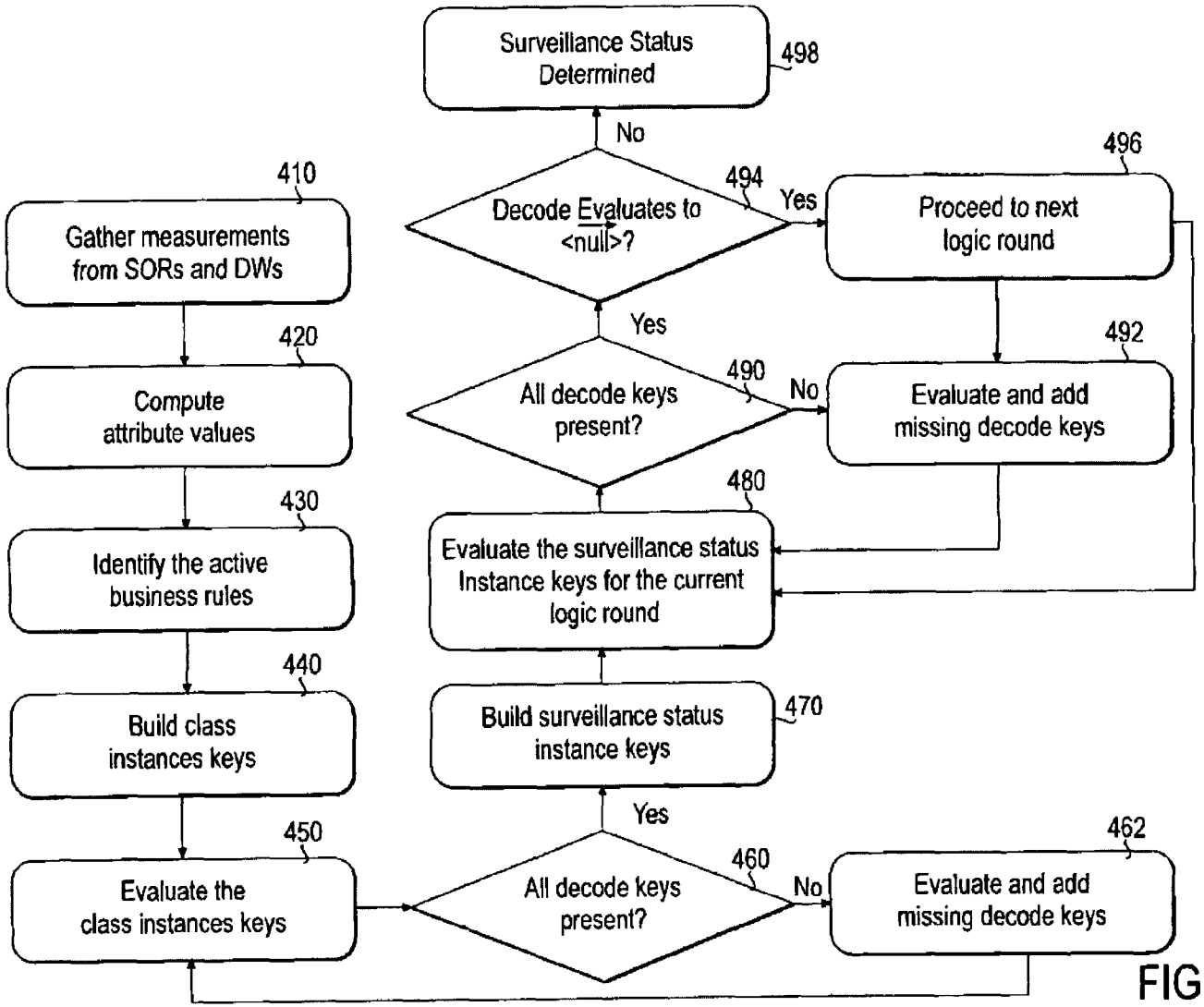
FIG. 4 is a flow diagram showing an exemplary method for well management in accordance with the present invention.

Referring now to FIG. 4, the field manager 110 of the present invention utilizes a multi-channel decoding process 400 for generating an overall well surveillance status. The multi-channel process begins with step 410, which involves gathering well-related data associated with each attributes. Proceeding to step 420, the method derives the numerical value for each attribute. Typically, attribute data is gathered over a near term window, for example over the period 60 days, for purposes of evaluating recent performance and comparing to longer periods of time, such as a year. In the case of recently serviced wells, the data window may be shortened to exclude the down period and a period of time, for example 14 days, following the time the well went back into service, thereby allowing the well performance to stabilize before monitoring resumes. In some cases the work is so recent that the window is not considered long enough and a diagnosis is deferred.

Figure 5A:
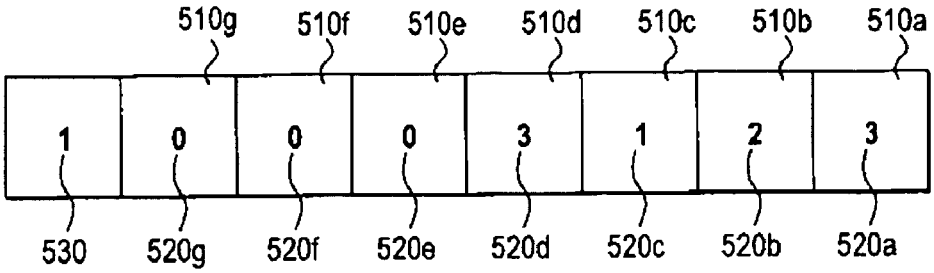
FIGS. 5*a* and *b* are exemplary classification instance and decode keys, respectively.

After all attribute values for all wells have been determined, the method of the present invention performs step 430. Here the method identifies the business rule in which the attribute's value occurred. Each rule has an associated identification (ID) number, which in accordance with Step 430 is recorded in a classification instance key corresponding to the performance class of which the attribute is a member. See for example FIG. 5*a*, which shows an exemplary classification instance key 500 for the Injection Performance class. Each attribute is assigned a predefined position, as shown for example by slots 510*a*-510*d*, corresponding to Injection Performance attributes "Injection Pressure Near Term Trend", "Injection Pressure to Target", "Injection Rate NT Trend", and "Injection Rate to Target," respectively. Slots 510*e*-510*g* are not assigned and thus set to zero. As shown in the example of FIG. 5*a*, key positions are defined from right to left with slot #1 being the right-most digit, and slot #7 being the left-most digit. Slot 530 does not pertain to a key position, but is always set to "1", thereby allowing the sequence to be recognized as an integer number for efficient data processing.

Figure 5B:
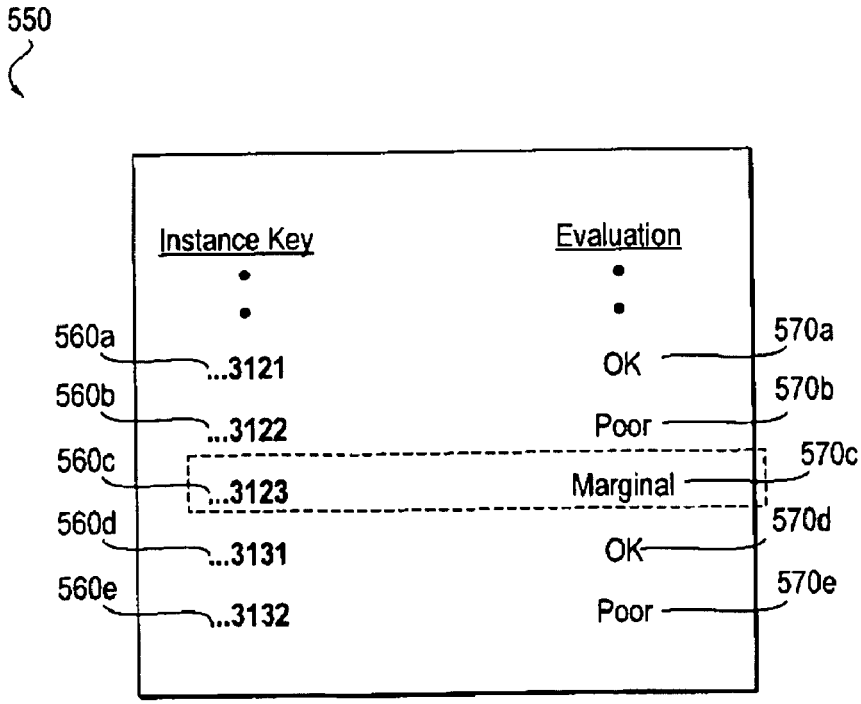

Referring to FIG. 5*b*, slots 510*a*-*g* are populated with values 520*a*-520*g* corresponding to the number of the 'active" business rules (BR's) for the each of the corresponding attributes. Slot 510*a* is populated with BR #3, "Injection Pressure is moderately rising," slot 510*b* with BR #2, "Injection Pressure is at limit", slot 510*c* with BR #1, "Injection Rate is falling"; and slot 510*d* with BR #3, "Injection Rate is below target." Again, Zeros in the key may also occur in active slots and indicate either that the attribute value fell outside the span of all business rules, or that the attribute's data set was incomplete, e.g. perhaps no measurement was available. This situation results in a partial key. Partial keys are permissible so long as they also have a matching decode key as discussed below.

Determining the class evaluation is a matter of matching the classification instance key to a master decode key for that class, as shown for example by Step 450 of FIG. 4. The decode keys are paramount to the classification process because they contain the business intelligence (diagnosis) for every unique occurrence of business rule combinations. This diagnosis may be obtained from subject matter experts, an arithmetic weighting procedure of the key digits, "reverse engineering" through the analysis of historical events and then determining the active business rules, or some other method. The classification instance key inherits the evaluation of the matching decode key, as shown for example in FIG. 5*b*, which assigns decode keys 570*a*-*e* denoted as "Ok", "Poor", "Marginal", etc. to key values 560*a*-*e*. In the case of instance key 500, the value 3123 is assigned a "Marginal" class status.

Over time the diagnosis of a particular set of business rules as identified by the instance key may need to be changed or decode keys may be added or deleted as required by the operator in accordance with Steps 460 and 462. For example, as the method is executed over time an attribute instance key may occur for which there is no corresponding decode. Adding business rules may also require adding new decode keys. To aid the operator in maintaining the suite of decode keys, a decode-key manager displays the descriptions of the impacted business rules (or class name at the surveillance level), the criticality value, and number of occurrences in the instance population. Using the decode-key manager, the operator may search for new keys for which a diagnosis does not exist and add them in accordance with Step 462. The manager may also need to change a key's diagnosis or remove keys no longer needed, e.g., as for keys assigned to business rules which are no longer used. The operator may provide a diagnosis for each key instance individually or assign several at once with the same diagnosis through the decode manager's combinatorial key filtering and updating ability. The decode-key manager ensures that all key instances have a corresponding decode key, flags those decode keys that require an evaluation.

Figure 6A:
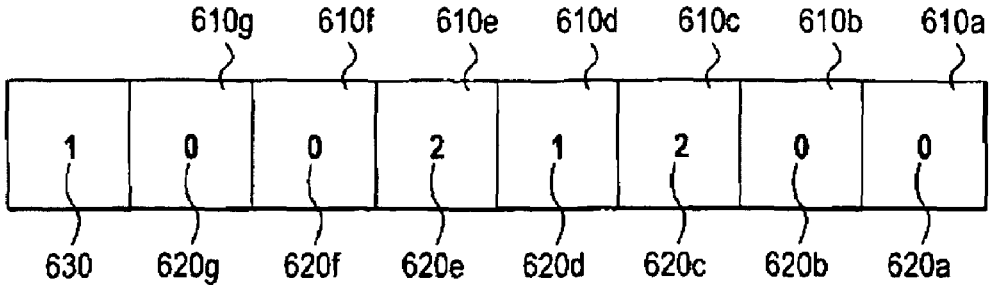
FIGS. 6*a* and 6*b* are exemplary well surveillance instance and decode keys, respectively.

The well surveillance status assessment, Steps 470-490, follows a similar procedure as the steps described above for performance class evaluations. Here, however, the classification evaluations themselves become the digits in a well surveillance instance key 600 as shown in FIG. 6*a*. By way of example, performance classes for water injection wells are assigned to slots 610*a*-*f* in a way similar to how attributes are assigned unique positions in class instance key 500 of FIG. 5*a*: the "Recent Activity" performance class is assigned to slot 610*a*, the "Injection Performance" class to slot 610*b*, the "Injection Measurement" performance class to slot 610*c*, the "Injection Support" performance class to slot 610*d*, and the "Injectivity" performance class to slot 610*e*.

Figure 6B:
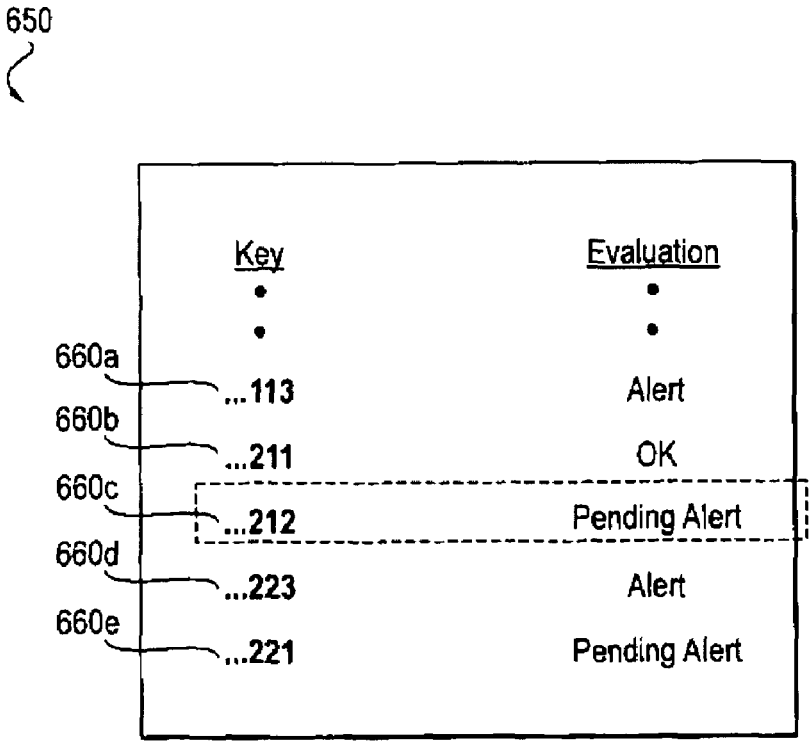

Class outputs 620*a*-*g* are set as shown in the example of FIG. 6*b*, with the Injection Performance class 610*c* shown as "Marginal" (Classification Status Rule #2), the Injection Support Performance class 610*d* shown as "OK" (Classification Status Rule #1), and the Injectivity class 610*e* shown as "Marginal" (Class Status Rule #2). As with the diagnostic determination of instance keys associated with a performance class, the interpretation of a well's key surveillance (or "Tier 2" rules) can be determined using heuristical, statistical or historical analysis methods. Optionally, the decode-key manager updates, adds or deletes surveillance decode keys, Step 492. The determination of the well's surveillance status, Step 498, then becomes a matter of matching the well's surveillance instance key to the list of decodes and reading the evaluation.

An advantage of the multi-tiered expert system approach of the present invention is that it improves the computational and storage efficiency of a well surveillance system by requiring the maintenance of significantly fewer decodes in the derivation of the a well surveillance status. Consider for example a system of having eleven attributes each having three business rules. Such a system would require $3^{11}$ or 177147 decode keys, a completely unmanageable number to maintain in an expert system. By comparison, a system in accordance with the present invention having the same eleven attributes dispersed among four performance classes with two attributes in the first class, two attributes in the second class, three attributes in the fourth class, and four attributes in the fourth class would reduce the total number of decodes to 207, without degrading the diagnostic capability of the surveillance system.

In accordance with the present invention, the above-referenced method of FIG. 4 may include Steps 494 and 496 to minimize the number of decodes without sacrificing the diagnostic capability. The number of decodes are minimized by bundling selected performance classes into "logic rounds" during surveillance status evaluation. A logic round is used to simulate sequencing of business logic that a subject matter expert may apply in the field. As such, a logic round enables the outcome of the current round to be a precondition for evaluating classes in subsequent logic rounds. Logic rounds are typically subject to the following rules: (1) a performance class may reside in only one logic round, (2) multiple performance classes may be assigned to the same logic round, and (3) the diagnosis of the current logic round becomes the surveillance status unless it evaluates to the "<null>" condition, in which case the method proceeds to the next logic round, Step 496.

As configured in the invention for production wells, logic round 1 contains the Recent Activity class, round 2 to the Measurement class, round 3 the Production Performance, Pump, and WOR classes, and round 4 the Wellbore class. Logically, a well that is being serviced or is down for whatever reason does not need to be further diagnosed. Therefore, the Recent Activity class 610*a* is assigned to the first logic round. A well having been recently serviced may be assigned "Recent Well Work" as its surveillance status and, as such, there is no need to proceed with evaluation of the other performance classes. A well that is operating and has not experienced recent work, however, will be flagged, i.e. assigned the '<null>' condition, in logic round 1 the flag to proceed to round 2. In round 2, if a well is characterized by measurements of poor quality, because the measurements are old or erratic or invalid for whatever reason, the poor measurement integrity would preclude using these measurements for well diagnostics. In this situation, the method assigns the well the surveillance status "Poor Measurement." Otherwise, the method proceeds to round 3 and the process repeats until a non-'<null>' evaluation is achieved.

Consider once again the exemplary multitier system having eleven attributes dispersed among 4 classes containing 3 business rules for each. But now assume that the 1st class falls in logic round 1, the $2^{nd}$ in logic round 2, and the $3^{rd}$ and $4^{th}$ in logic round 3. By introducing the ability to sequence the interpretation through the use of logic rounds, the number of decode keys to maintain now becomes 143, a 30% reduction over just implementing the multitier approach. In general the number of decode keys should be below one thousand when maintained by a domain expert. This suggests that up to six performance classes, with approximately three to five attributes per class, two to four business rules per attribute, and between one and three logic rounds will provide a system of rich diagnostic capability with manageable number of decode keys.

Figure 7A:
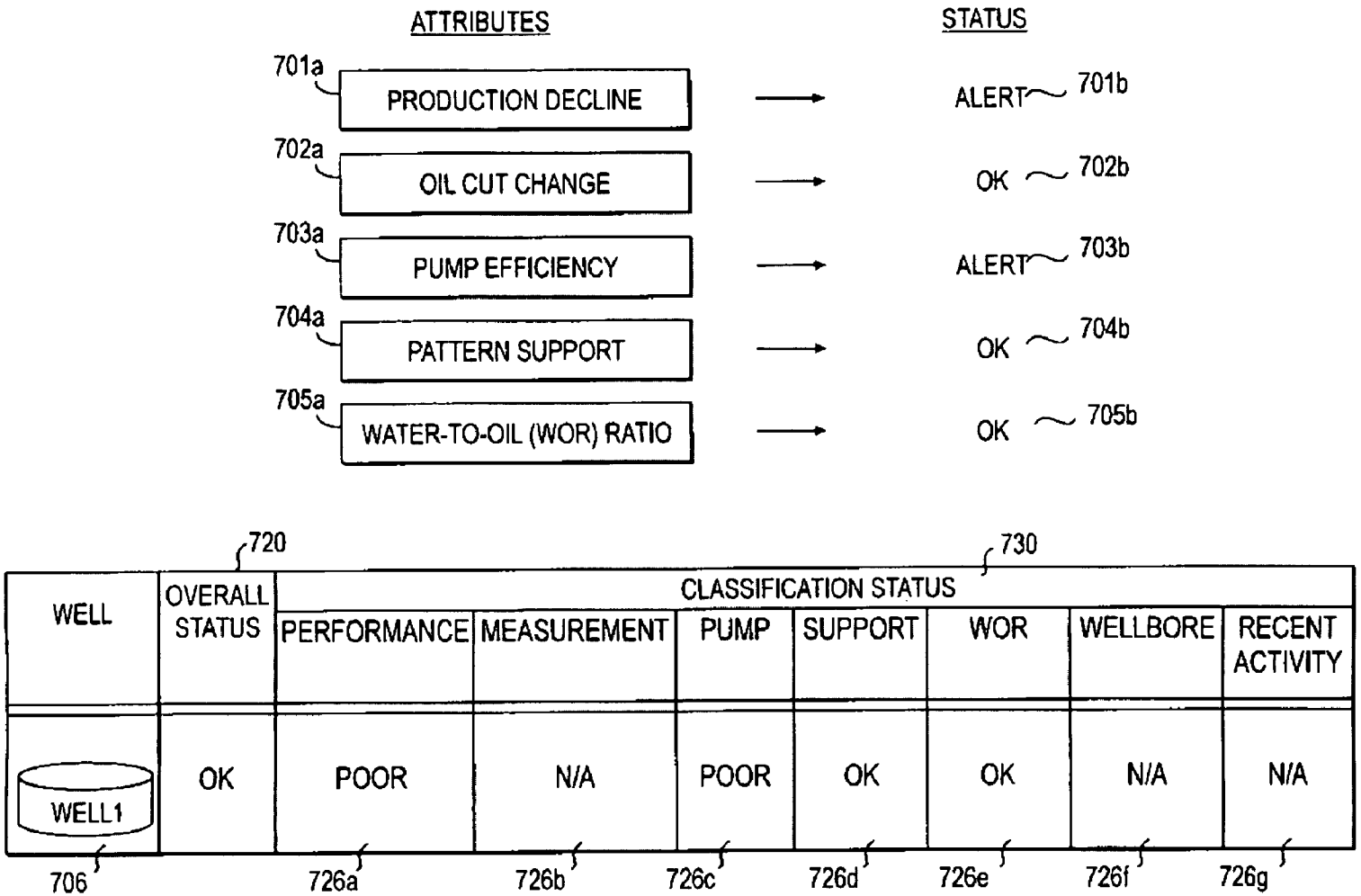
FIGS. 7*a* and 7*b* are exemplary displays showing well attributes, well attribute statuses, well performance classifications and evaluations, and overall well surveillance status in accordance with the present invention.
Figure 7B:
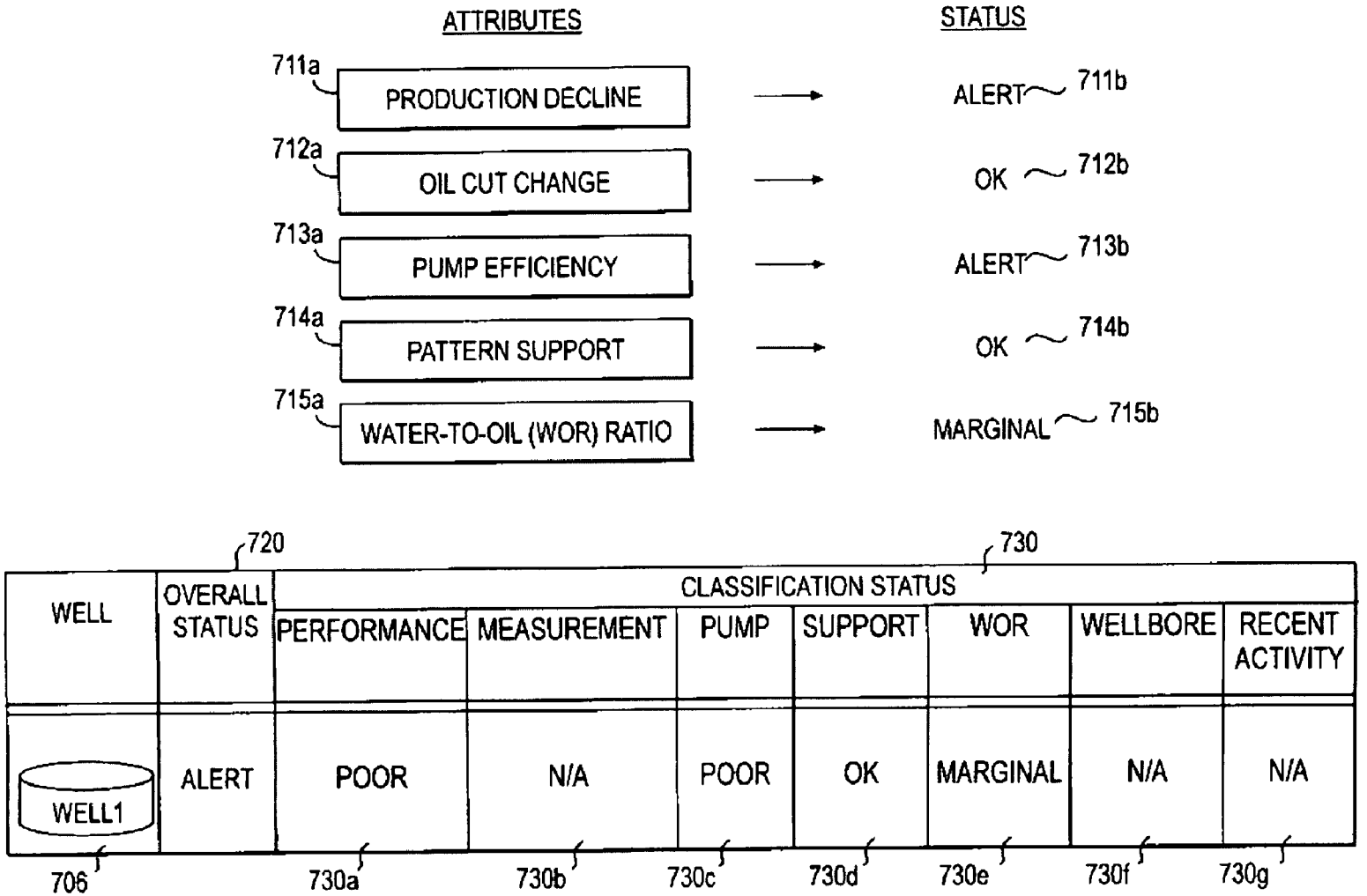

As such, the sequenced, multi-tiered expert system approach of the present invention is especially advantageous for managing large field or groups or many wells "by exception." While conventional well surveillance tools are useful for indicating abnormal or alert statuses, they do not possess the necessary intelligence required to manage anything other than the individual attribute evaluations. They operate as single-channel logic switches. Consider for example FIG. 7*a* showing Producer well attributes 701*a*-705*a* and corresponding well attribute statuses 701*b*-705*b*. In accordance with conventional surveillance tools, one or both of the statuses for "Production Decline" 701*a* and "Pump Efficiency" 703*b* may cause an operator to perform a more detailed investigation of the pump condition or disable the well, when in fact the culprit to poor production in this case is poor pattern support as illustrated in FIG. 7*b*. The multi-channel logic would indicate that the pump performance is acceptable because the low efficiency is expected for a non-POC pump running continuously as the Pump diagnosis would indicate. In similar situations, conventional tools may display several individual attribute alerts thus falsely suggesting to an inexperienced operator that well operation may be "unacceptable," thus leaving the operator with little direction for prioritizing responsive actions, and limited opportunities for identifying under-performing wells or operating conditions that are not truly not "unacceptable" or of lower priority with respect to other well operating conditions. Integrating the pieces of information, again in a multichannel fashion as proposed by the invention, may indicate for example that rising tubing head pressure, reduced injection rate, and low IWR may be acceptable in the absence of surface expression.

The present invention therefore can be used to quickly identify wells with the worst performance and reduce the time between when the well was put on alert status, reviewed, and a work order written for the well. The system and method of the present invention, for example, has been shown to reduce the current time cycle for maintenance and service operations, and to substantially increase the number of wells reviewed during pre-defined well review periods. In addition, the present invention can be used to mitigate undesired subsurface events in oil field operations (e.g., production losses), and to identify additional production opportunities in the wellbore.

The method of the invention provides several other benefits to the well surveillance workflow. Because the invention provides a mechanism to standardize the process across the oilfield, it essentially becomes a business intelligence repository and an excellent means for training new employees, knowledge transfer and troubleshooting. The automation of complex calculations in accordance with the present invention, that a well operator previously computed by hand or with spreadsheets in an ad hoc manner, now allows the operator to focus more time on diagnosis and problem resolution than data preparation and interpretation. Being a computation algorithm that may be run repeatedly, it also ensures the diagnosis is consistent, reliable and of high quality. The highly structured nature of the database which underlies the method makes it relatively easy to maintain the field's business logic as it evolves over time. New classes, attributes and business rules may be added, existing ones modified or deleted without adding or changing database objects. Similarly instance key evaluations may be changed, added and deleted without impacting the data structure.

The present invention can also be used to provide training and troubleshooting assistance, and to establish uniform well evaluation and benchmarking across selected sites, a field or across one or more business units. The invention helps ensure repeatability and reliability of well diagnosis through consistent application of best-practice business rules.

FIGS. 8-10 are exemplary displays related to the well surveillance system and method of the present invention. FIG. 8 is a display 800 showing a summary listing of "under-performing" or "alert" wells in accordance with the present invention. Display 800 also includes a "My Watch List" area 820 for displaying status information for selected wells of interest. FIG. 9 is an exemplary display 900 showing well classification statistics 930-950 for each well performance classification 920 by well class 910. FIG. 10 is a display 1000 showing overall well statuses 1010 by well performance classification combinations 1020-1080.

FIG. 11 is an exemplary display 1100 showing overall well surveillance statuses 1120 for neighborhood wells corresponding to target well 1130. Some attributes compare a well to the average performance of its offset neighbors, or "well group." Preferably, the group includes wells which are located along an ellipse centered on the well being evaluated. In accordance with a preferred embodiment, the user has the option of the defining the ellipse by entering the following parameters: "long axis, long-to-short axis ratio, and northing-of-the-long axis. An option also exists to incorporate zonal commonality as a grouping criterion, wherein zonal commonality refers to open wells zones (in the depth-wise "down hole" direction) shares by target and neighbor wells.

Other embodiments of the present invention and its individual components will become readily apparent to those skilled in the art from the foregoing detailed description. As will be realized, the invention is capable of other and different embodiments, and its several details are capable of modifications in various obvious respects, all without departing from the spirit and the scope of the present invention. Accordingly, the drawings and detailed description are to be regarded as illustrative in nature and not as restrictive. It is therefore not intended that the invention be limited except as indicated by the appended claims.

What is claimed is:

1. A computer-implemented method for well surveillance comprising:

defining, via a computer processor, a plurality of well attributes representative of well operating parameters;

determining, via the processor, attribute statuses for each of the well attributes;

defining, via the processor, a plurality of well performance classifications;

mapping, via the processor, related ones of the well attributes into one or more of the well performance classifications;

deriving, via the processor, well performance classification statuses for each of the well classifications, comprising the steps of (a) determining, for each of the well performance classifications, business rule values corresponding to the mapped well attributes, (b) assembling, for each of the well performance classifications, a well performance classification instance key comprising a combination of the business rule values, and (c) decoding, for each of the well performance classifications, the well performance classification instance key in accordance with a corresponding well performance classification decode key that assigns the well performance classification statuses based on the combination of the business rule values; and deriving, via the processor, an overall well status based on a combination of the well performance classification statuses, comprising the steps of (a) determining well performance classification status values representative of each of the well performance classification statuses, (b) assembling a surveillance instance key comprising a combination of the well performance classification status values, and (c) decoding the surveillance instance key in accordance with a corresponding surveillance decode key that assigns the overall well status based on the combination of the well performance classification status values.

2. The method of claim 1, further comprising displaying one or more of the well attribute statuses, the well performance classification statuses, and the overall well status.

3. The method of claim 1, further comprising using one or more logic rounds to derive the overall well status.

4. A well surveillance system comprising:

one or more devices for capturing well attribute data; and a computer processor for processing comprising computer executable code for:

defining, via a computer processor, a plurality of well attributes representative of well operating parameters;

determining, via the processor, attribute statuses for each of the well attributes;

defining, via the processor, a plurality of well performance classifications;

mapping, via the processor, related ones of the well attributes into one or more of the well performance classifications;

deriving, via the processor, well performance classification statuses for each of the well classifications, comprising the steps of (a) determining, for each of the well performance classifications, business rule values corresponding to the mapped well attributes, (b) assembling, for each of the well performance classifications, a well performance classification instance key comprising a combination of the business rule values, and (c) decoding, for each of the well performance classifications, the well performance classification instance key in accordance with a corresponding well performance classification decode key that assigns the well performance classification statuses based on the combination of the business rule; and deriving, via the processor, an overall well status based on a combination of the well performance classification statuses, comprising the steps of (a) determining well performance classification status values representative of each of the well performance classification statuses, (b) assembling a surveillance instance key comprising a combination of the well performance classification status values, and (c) decoding the surveillance instance key in accordance with a corresponding surveillance decode key that assigns the overall well status based on the combination of the well performance classification status values.

5. The system of claim 4, wherein the display device displays the well attribute statuses.

6. The system of claim 4, wherein the display device displays the well performance classification statuses.

7. A non-transitory computer-readable medium containing instructions stored therein for causing a computer processor to perform a method of managing well operations, the instructions comprising:

well attribute processing code for defining a plurality of well attributes representative of well operating parameters and for determining attribute statuses for each of the well attributes;

well performance classification processing code in communication with the well attribute processing code for defining a plurality of well performance classifications, grouping related ones of the well attributes into one or more of the well performance classifications, and deriving well performance classification statuses for each of the well performance classifications by (a) determining, for each of the well performance classifications, business rule values corresponding to the mapped well attributes, (b) assembling, for each of the well performance classifications, a well performance classification instance key comprising a combination of the business rule values, and (c) decoding, for each of the well performance classifications, the well performance classification instance key in accordance with a corresponding well performance classification decode key that assigns the well performance classification statuses based on the combination of the business rule; and well status processing code in communication with the well performance classification processing code for deriving an overall well status by (a) determining well performance classification status values representative of each of the well performance classification statuses, (b) assembling a surveillance instance key comprising a combination of the well performance classification status values, and (c) decoding the surveillance instance key in accordance with a corresponding surveillance decode key that assigns the overall well status based on the combination of the well performance classification status values.

8. The computer-readable medium of claim 7, further comprising logic round processing code for using one or more logic rounds to derive the overall well status.

9. The computer-readable medium of claim 7, further comprising display generation code for displaying the well attribute statuses, well performance classification statuses, and displaying the overall well status.

* * * * *